US008777396B2

(12) United States Patent
Mizes et al.

(10) Patent No.: US 8,777,396 B2
(45) Date of Patent: Jul. 15, 2014

(54) SYSTEM AND METHOD FOR IMAGING AND EVALUATING PRINTING PARAMETERS IN AN AQUEOUS INKJET PRINTER

(71) Applicant: Xerox Corporation, Norwalk, CT (US)

(72) Inventors: Howard A. Mizes, Pittsford, NY (US); Jeffrey J. Folkins, Rochester, NY (US); Paul J. McConville, Webster, NY (US); David A. Mantell, Rochester, NY (US); Anthony S. Condello, Webster, NY (US); Chu-heng Liu, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 50 days.

(21) Appl. No.: 13/720,368

(22) Filed: Dec. 19, 2012

(65) Prior Publication Data

US 2014/0168312 A1 Jun. 19, 2014

(51) Int. Cl.
*B41J 2/01* (2006.01)

(52) U.S. Cl.
USPC ..... 347/103

(58) Field of Classification Search
CPC ..... B41J 2/0057
USPC ..... 347/103
See application file for complete search history.

(56) References Cited

U.S. PATENT DOCUMENTS

| | | | | |
|---|---|---|---|---|
| 5,966,157 | A * | 10/1999 | Dolan | 347/103 |
| 6,113,231 | A * | 9/2000 | Burr et al. | 347/103 |
| 6,213,580 | B1 * | 4/2001 | Segerstrom et al. | 347/19 |
| 6,335,978 | B1 | 1/2002 | Moscato et al. | |
| 7,021,732 | B2 * | 4/2006 | Folkins | 347/8 |
| 7,623,254 | B2 * | 11/2009 | Eklund et al. | 358/1.14 |
| 7,686,445 | B2 | 3/2010 | Fioravanti et al. | |
| 7,708,371 | B2 * | 5/2010 | Yamanobe | 347/19 |
| 7,854,490 | B2 * | 12/2010 | Snyder | 347/19 |
| 7,866,782 | B2 * | 1/2011 | Borton | 347/19 |
| 7,869,099 | B2 | 1/2011 | Mashtare | |
| 8,132,885 | B2 | 3/2012 | Ramakrishnan et al. | |
| 8,243,291 | B2 * | 8/2012 | Kojima | 358/1.1 |

* cited by examiner

*Primary Examiner* — Julian Huffman
(74) *Attorney, Agent, or Firm* — Maginot, Moore & Beck, LLP

(57) ABSTRACT

An aqueous inkjet printer is configured to evaluate and adjust multiple components within the printer with reference to image data of the surface of a rotating member obtained at different times during a single print cycle. The print cycle can be performed in a multiple pass manner to enable a single optical sensor to be used for generation of the image data. Alternatively, the print cycle can be performed in a single revolution of the rotating member and multiple optical sensors positioned about the rotating member to generate the image data.

19 Claims, 5 Drawing Sheets

SYSTEM AND METHOD FOR IMAGING AND EVALUATING PRINTING PARAMETERS IN AN AQUEOUS INKJET PRINTER

TECHNICAL FIELD

This disclosure relates generally to aqueous indirect inkjet printers, and, in particular, to image quality evaluation and correction in aqueous ink inkjet printing.

BACKGROUND

In general, inkjet printing machines or printers include at least one printhead that ejects drops or jets of liquid ink onto a recording or image forming surface. An aqueous inkjet printer employs water-based or solvent-based inks in which pigments or other colorants are suspended or in solution. Once the aqueous ink is ejected onto an image receiving surface by a printhead, the water or solvent is evaporated to stabilize the ink image on the image receiving surface. When aqueous ink is ejected directly onto media, the aqueous ink tends to soak into the media when it is porous, such as paper, and change the size and location of the drop of ink from its intended position. To address this issue, a printer that ejects ink onto an intermediate surface has been developed. These printers are referred to as indirect printers in this document. One such printer ejects ink onto a rotating intermediate imaging surface, which is usually in the form of a rotating drum or endless belt. The ink is dried or partially dried on the member and then transferred to media. Such a printer avoids the changes in media properties that occur in response to media contact with the water or solvents in aqueous ink. Indirect printers also reduce the effect of variations in other media properties that arise from the use of widely disparate types of paper and films used to hold the final ink images.

In these indirect printers, the intermediate imaging surface has two competing requirements. The ink should adhere strongly to the location to which it was directed, yet be able to transfer from the intermediate imaging surface member to the media after it is dried. These goals can be achieved by applying a coating material to the blanket. Coating materials have a variety of purposes that include wetting the intermediate imaging surface, inducing solids to precipitate out of the liquid ink, providing a solid matrix for the colorant in the ink, and/or aiding in the release of the printed image from the intermediate imaging surface. Because the intermediate imaging surfaces are likely to be surfaces with low surface energy, reliable coating is a challenge. If the coating is too thin, it may fail to form a layer adequate to support an ink image. If the coating is too thick, a disproportionate amount of the coating may be transferred to media with the final image. Image defects arising from either phenomenon may significantly degrade final image quality.

Parameters other than coating thicknesses also affect image quality in an aqueous indirect inkjet printer. These parameters include coalescence of the ejected ink drops, spread of the ink drops, and inter-color bleed of adjacent ink drops in the process and cross process directions. These issues are not encountered or are not as severe in printing with other inks, such as solid or phase change inks, which become solid upon contact with the media. Also, the ink image changes as the ink dries. Consequently, evaluation of ink image status for high efficiency transfer of an ink image and coherence of the ink image for transfer is important and varies depending upon the position of the ink image in the print cycle. Moreover, after the ink image is transferred, the efficiency of the transfer and any subsequent cleaning of the intermediate imaging surface require evaluation as well. Analyzing the transfer of the ink image to the media and measuring the overall quality of the ink image on the media can also be important. Structuring printers and configuring the components in an aqueous printer to evaluate and adjust these various parameters at appropriate places in a printer remains a significant goal for making aqueous printers that reliably produce images on media with acceptable quality.

SUMMARY

An aqueous printer enables evaluation operational parameters of different components in the printer and adjustment of different printer components in the printer from analysis of one or more images of the intermediate imaging surface. The printer includes at least one printhead configured to eject aqueous ink, a rotating member positioned to rotate in front of the at least one printhead to enable the at least one printhead to eject aqueous ink onto the surface of the rotating member and form an aqueous ink image on the surface of the rotating member, at least one optical sensor configured to generate image data of the surface of the rotating member, and a controller. The controller is operatively connected to the at least one optical sensor and is configured to receive from the at least one optical sensor image data of the surface of the rotating member and identify a parameter of at least one of the at least one printhead and the surface of the rotating member.

The controller can be further configured to receive from the at least one optical sensor image data of the surface of the rotating member at a first time, identify a parameter of one of the at least one printhead and the surface of the rotating member with reference to the image data received at the first time, receive from the at least one optical sensor image data of the surface of the rotating member at a second time, identify a parameter of the other of the at least one printhead and the surface of the rotating member with reference to the image data received at the second time, one of the first time and the second time occurring later than the other of the first time and the second time, and both the first time and the second time occurring during a single print cycle.

DETAILED DESCRIPTION

Figure 1:
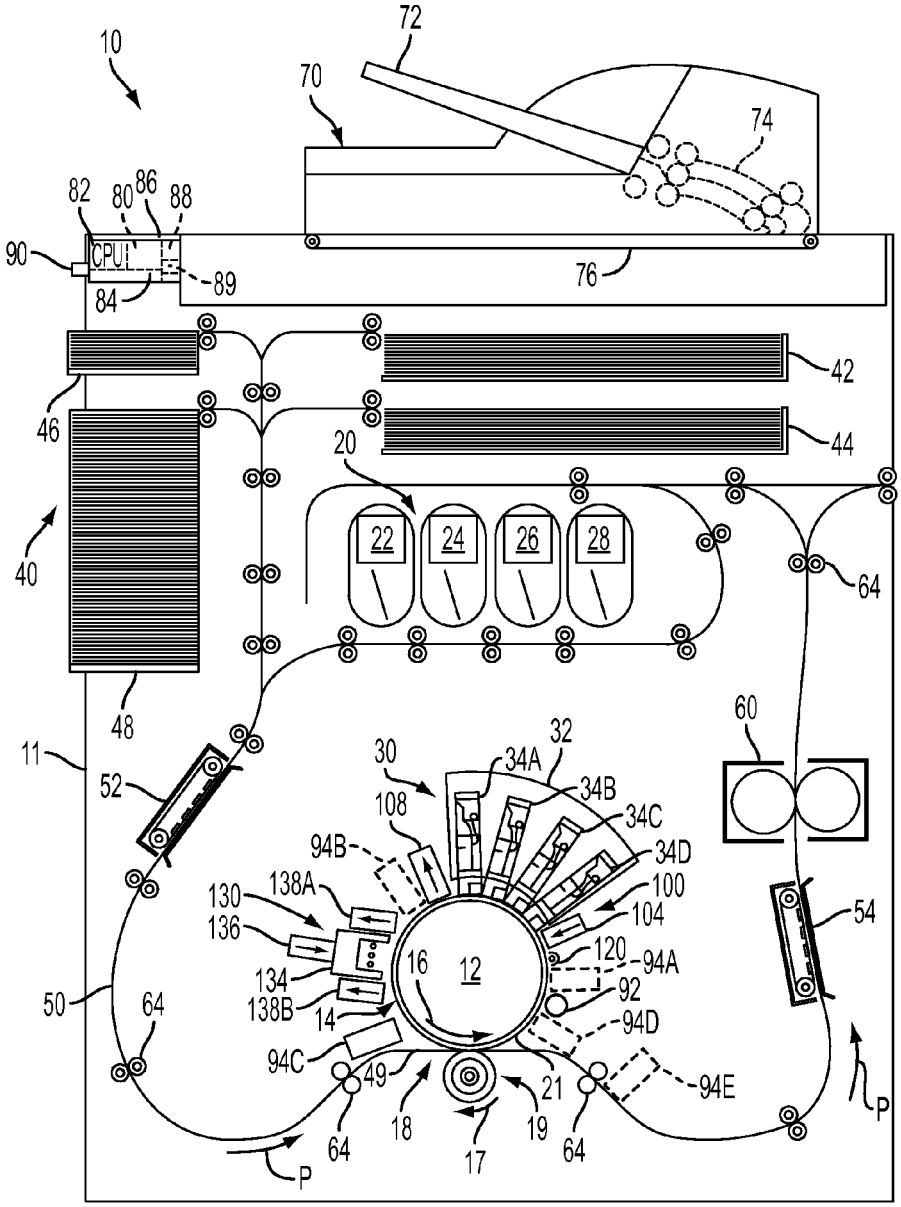
FIG. 1 is a schematic drawing of an aqueous indirect inkjet printer that produces ink images on media sheets.

For a general understanding of the present embodiments, reference is made to the drawings. In the drawings, like reference numerals have been used throughout to designate like elements. As used herein, the terms "printer," "printing device," or "imaging device" generally refer to a device that produces an image with one or more colorants on print media and may encompass any such apparatus, such as a digital copier, bookmaking machine, facsimile machine, multi-function machine, or the like, which generates printed images for any purpose. Image data generally include information in electronic form which are rendered and used to operate the inkjet ejectors to form an ink image on the print media. These data can include text, graphics, pictures, and the like. The operation of producing images with colorants on print media, for example, graphics, text, photographs, and the like, is generally referred to herein as printing or marking. Phase-change ink printers use phase-change ink, also referred to as a solid ink, which is in a solid state at room temperature but melts into a liquid state at a higher operating temperature. The liquid ink drops are printed onto an image receiving surface in either a direct or indirect printer.

The term "printhead" as used herein refers to a component in the printer that is configured with inkjet ejectors to eject ink drops onto an image receiving surface. A typical printhead includes a plurality of inkjet ejectors that eject ink drops of one or more ink colors onto the image receiving surface in response to firing signals that operate actuators in the inkjet ejectors. The inkjets are arranged in an array of one or more rows and columns. In some embodiments, the inkjets are arranged in staggered diagonal rows across a face of the printhead. Various printer embodiments include one or more printheads that form ink images on an image receiving surface. Some printer embodiments include a plurality of printheads arranged in a print zone. An image receiving surface, such as a print medium or the surface of an intermediate member that carries an ink image, moves past the printheads in a process direction through the print zone. The inkjets in the printheads eject ink drops in rows in a cross-process direction, which is perpendicular to the process direction across the image receiving surface. As used in this document, the term "aqueous ink" includes liquid inks in which colorant is in solution with water and/or one or more solvents.

FIG. 1 illustrates a high-speed aqueous ink image producing machine or printer 10. As illustrated, the printer 10 is an indirect printer that forms an ink image on a surface of a blanket 21 mounted about an intermediate rotating member 12 and then transfers the ink image to media passing through a nip 18 formed with the blanket 21 and intermediate rotating member 12. A print cycle is now described with reference to the printer 10. As used in this document, "print cycle" refers to the operations of a printer to prepare an imaging surface for printing, ejection of the ink onto the prepared surface, treatment of the ink on the imaging surface to stabilize and prepare the image for transfer to media, and transfer of the image from the imaging surface to the media.

The printer 10 includes a frame 11 that supports directly or indirectly operating subsystems and components, which are described below. The printer 10 includes an intermediate rotating member 12 that is shown in the form of a drum, but can also be configured as a supported endless belt. The intermediate rotating member 12 has an outer blanket 21 mounted about the circumference of the member 12. The blanket moves in a direction 16 as the member 12 rotates. A transfix roller 19 rotatable in the direction 17 is loaded against the surface of blanket 21 to form a transfix nip 18, within which ink images formed on the surface of blanket 21 are transfixed onto a media sheet 49.

The blanket is formed of a material having a relatively low surface energy to facilitate transfer of the ink image from the surface of the blanket 21 to the media sheet 49 in the nip 18. Such materials include ??. A surface maintenance unit (SMU) 92 removes residual ink left on the surface of the blanket 21 after the ink images are transferred to the media sheet 49. The low energy surface of the blanket does not aid in the formation of good quality ink images because drops of ink form a high contact angle and do not wet the surface and spread as well as they do on high surface energy materials. Consequently, some embodiments of SMU 92 also apply a coating to the blanket surface. The coating helps aid in wetting the surface of the blanket, inducing solids to precipitate out of the liquid ink, providing a solid matrix for the colorant in the ink, and aiding in the release of the ink image from the blanket. Such coatings include surfactants, starches, and the like. In other embodiments, a surface energy applicator 120, which is described in more detail below, operates to treat the surface of blanket for improved formation of ink images without requiring application of a coating by the SMU 92.

The SMU 92 can include a coating applicator having a reservoir with a fixed volume of coating material and a resilient donor roller, which can be smooth or porous and is rotatably mounted in the reservoir for contact with the coating material. The donor roller can be an elastomeric roller made of a material such as anilox. The coating material is applied to the surface of the blanket 21 to form a thin layer on the blanket surface. The SMU 92 is operatively connected to a controller 80, described in more detail below, to enable the controller to operate the donor roller, metering blade and cleaning blade selectively to deposit and distribute the coating material onto the surface of the blanket and remove un-transferred ink pixels from the surface of the blanket 21.

The printer 10 includes an optical sensor 94A, also known as an image-on-drum ("IOD") sensor, which is configured to detect light reflected from the blanket surface 14 and the coating applied to the blanket surface as the member 12 rotates past the sensor. The optical sensor 94A includes a linear array of individual optical detectors that are arranged in the cross-process direction across the blanket 21. The optical sensor 94A generates digital image data corresponding to light that is reflected from the blanket surface 14 and the coating. The optical sensor 94A generates a series of rows of image data, which are referred to as "scanlines," as the image receiving member 12 rotates the blanket 21 in the direction 16 past the optical sensor 94A. In one embodiment, each optical detector in the optical sensor 94A further comprises three sensing elements that are sensitive to wavelengths of light corresponding to red, green, and blue (RGB) reflected light colors. Alternatively, the optical sensor 94A includes illumination sources that shine red, green, and blue light or, in another embodiment, the sensor 94A has an illumination source that shines white light onto the surface of blanket 21 and white light detectors are used. The optical sensor 94A shines complementary colors of light onto the image receiving surface to enable detection of different ink colors using the photodetectors. The image data generated by the optical sensor 94A is analyzed by the controller 80 or other processor in the printer 10 to identify the thickness of the coating on the blanket and the area coverage. The thickness and coverage can be identified from either specular or diffuse light reflection from the blanket surface and/or coating. Other optical sensors, such as 94B, 94C, and 94D, are similarly configured and can be located in different locations around the blanket 21 to identify and evaluate other parameters in the printing process, such as missing or inoperative inkjets and ink image formation prior to image drying (94B), ink image treatment for image transfer (94C), and the efficiency of the ink image transfer (94D). Alternatively, some embodiments can include an optical sensor to generate additional data that can be used for evaluation of the image quality on the media (94E).

The printer 10 also includes a surface energy applicator 120 positioned next to the blanket surface at a position immediately prior to the surface of the blanket 21 entering the print zone formed by printhead modules 34A-34D. The surface energy applicator 120 can be, for example, a corotron, a scorotron, or biased charge roller. The surface energy applicator 120 is configured to apply a high electric field between a wire in the applicator 120 and a surface in the applicator that is sufficient to ionize the air in the applicator. A bias voltage applied between the applicator and the blanket 21 causes either negatively charged particles or positively charged particles to impact the blanket surface and/or the coating. The charged particles increase the surface energy of the blanket surface and/or coating. The increased surface energy of the surface of the blanket 21 enables the ink drops subsequently ejected by the printheads in the modules 34A-34D to be spread adequately to the blanket surface 21 and not coalesce.

The printer 10 includes an airflow management system 100, which generates and controls a flow of air through the print zone. The airflow management system 100 includes a printhead air supply 104 and a printhead air return 108. The printhead air supply 104 and return 108 are operatively connected to the controller 80 or some other processor in the printer 10 to enable the controller to manage the air flowing through the print zone. This regulation of the air flow can be through the print zone as a whole or about one or more printhead arrays. The regulation of the air flow helps prevent evaporated solvents and water in the ink from condensing on the printhead and helps attenuate heat in the print zone to reduce the likelihood that ink dries in the inkjets, which can clog the inkjets. The airflow management system 100 can also include sensors to detect humidity and temperature in the print zone to enable more precise control of the temperature, flow, and humidity of the air supply 104 and return 108 to ensure optimum conditions within the print zone. Controller 80 or some other processor in the printer 10 can also enable control of the system 100 with reference to ink coverage in an image area or even to time the operation of the system 100 so air only flows through the print zone when an image is not being printed.

The high-speed aqueous ink printer 10 also includes an aqueous ink supply and delivery subsystem 20 that has at least one source 22 of one color of aqueous ink. Since the illustrated printer 10 is a multicolor image producing machine, the ink delivery system 20 includes four (4) sources 22, 24, 26, 28, representing four (4) different colors CYMK (cyan, yellow, magenta, black) of aqueous inks. In the embodiment of FIG. 1, the printhead system 30 includes a printhead support 32, which provides support for a plurality of printhead modules, also known as print box units, 34A through 34D. Each printhead module 34A-34D effectively extends across the width of the blanket and ejects ink drops onto the surface 14 of the blanket 21. A printhead module can include a single printhead or a plurality of printheads configured in a staggered arrangement. Each printhead module is operatively connected to a frame (not shown) and aligned to eject the ink drops to form an ink image on the coating on the blanket surface 14. The printhead modules 34A-34D can include associated electronics, ink reservoirs, and ink conduits to supply ink to the one or more printheads. In the illustrated embodiment, conduits (not shown) operatively connect the sources 22, 24, 26, and 28 to the printhead modules 34A-34D to provide a supply of ink to the one or more printheads in the modules. As is generally familiar, each of the one or more printheads in a printhead module can eject a single color of ink. In other embodiments, the printheads can be configured to eject two or more colors of ink. For example, printheads in modules 34A and 34B can eject cyan and magenta ink, while printheads in modules 34C and 34D can eject yellow and black ink. The printheads in the illustrated modules are arranged in two arrays that are offset, or staggered, with respect to one another to increase the resolution of each color separation printed by a module. Such an arrangement enables printing at twice the resolution of a printing system only having a single array of printheads that eject only one color of ink. Although the printer 10 includes four printhead modules 34A-34D, each of which has two arrays of printheads, alternative configurations include a different number of printhead modules or arrays within a module.

After the printed image on the blanket surface 14 exits the print zone, the image passes under an image dryer 130. The image dryer 130 includes an infrared heater 134, a heated air source 136, and air returns 138A and 138B. The infrared heater 134 applies infrared heat to the printed image on the surface 14 of the blanket 21 to evaporate water or solvent in the ink. The heated air source 136 directs heated air over the ink to supplement the evaporation of the water or solvent from the ink. The air is then collected and evacuated by air returns 138A and 138B to reduce the interference of the air flow with other components in the printing area.

As further shown, the printer 10 includes a recording media supply and handling system 40 that stores, for example, one or more stacks of paper media sheets of various sizes. The recording media supply and handling system 40, for example, includes sheet or substrate supply sources 42, 44, 46, and 48. In the embodiment of printer 10, the supply source 48 is a high capacity paper supply or feeder for storing and supplying image receiving substrates in the form of cut media sheets 49, for example. The recording media supply and handling system 40 also includes a substrate handling and transport system 50 that has a media pre-conditioner assembly 52 and a media post-conditioner assembly 54. The printer 10 includes an optional fusing device 60 to apply additional heat and pressure to the print medium after the print medium passes through the transfix nip 18. In the embodiment of FIG. 1, the printer 10 includes an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 is operably connected to the image receiving member 12, the printhead modules 34A-34D (and thus the printheads), the substrate supply and handling system 40, the substrate handling and transport system 50, and, in some embodiments, the one or more optical sensors 94A-94E. The ESS or controller 80, for example, is a self-contained, dedicated mini-computer having a central processor unit (CPU) 82 with electronic storage 84, and a display or user interface (UI) 86. The ESS or controller 80, for example, includes a sensor input and control circuit 88 as well as a pixel placement and control circuit 89. In addition, the CPU 82 reads, captures, prepares and manages the image data flow between image input sources, such as the scanning system 76, or an online or a work station connection 90, and the printhead modules 34A-34D. As such, the ESS or controller 80 is the main multi-tasking processor for operating and controlling all of the other machine subsystems and functions, including the printing process discussed below.

The controller 80 can be implemented with general or specialized programmable processors that execute programmed instructions. The instructions and data required to perform the programmed functions can be stored in memory associated with the processors or controllers. The processors, their memories, and interface circuitry configure the controllers to perform the operations described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits.

In operation, image data for an image to be produced are sent to the controller 80 from either the scanning system 76 or via the online or work station connection 90 for processing and generation of the printhead control signals output to the printhead modules 34A-34D. Additionally, the controller 80 determines and/or accepts related subsystem and component controls, for example, from operator inputs via the user interface 86, and accordingly executes such controls. As a result, aqueous ink for appropriate colors are delivered to the printhead modules 34A-34D. Additionally, pixel placement control is exercised relative to the blanket surface 14 to form ink images corresponding to the image data, and the media, which can be in the form of media sheets 49, are supplied by any one of the sources 42, 44, 46, 48 and handled by recording media transport system 50 for timed delivery to the nip 18. In the nip 18, the ink image is transferred from the blanket and coating 21 to the media substrate within the transfix nip 18.

Figure 2:
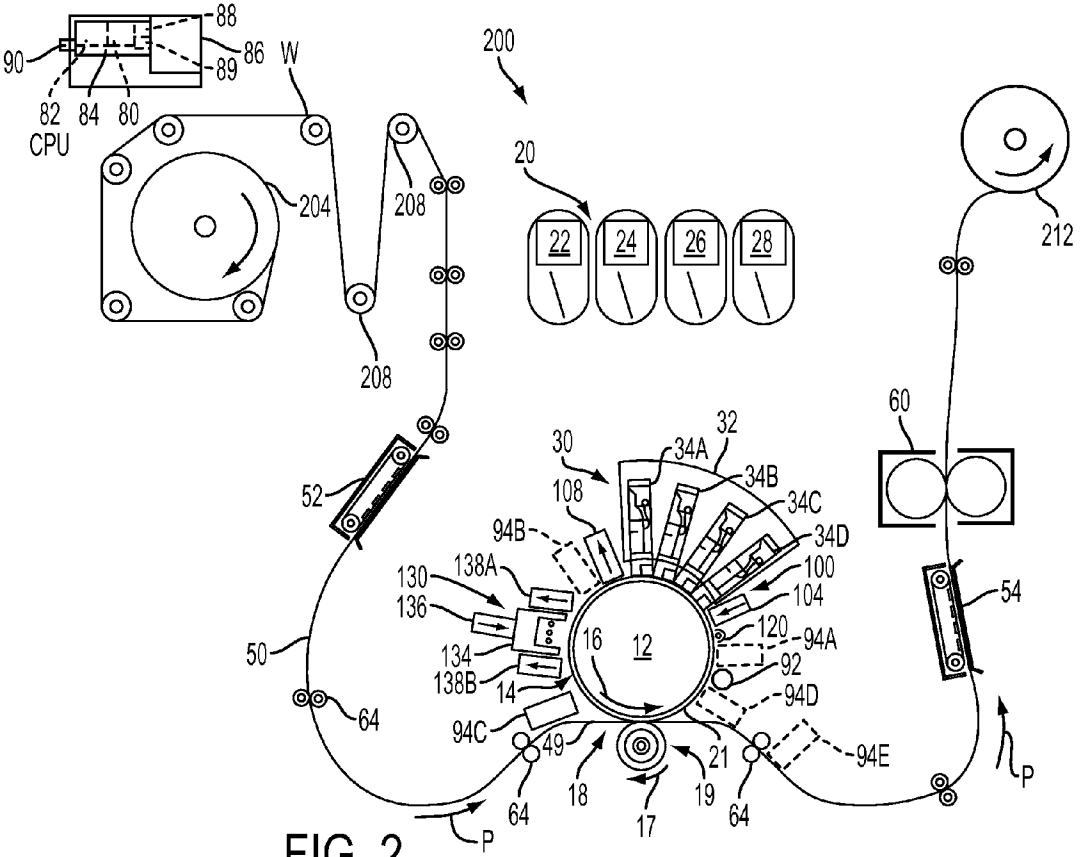
FIG. 2 is a schematic drawing of an aqueous indirect inkjet printer that produces ink images on a continuous media web.

Although the printer 10 in FIG. 1 and the printer 200 in FIG. 2 are described as having a blanket 21 mounted about an intermediate rotating member 12, other configurations of an image receiving surface can be used. For example, the intermediate rotating member can have a surface integrated into its circumference that enables an aqueous ink image to be formed on the surface. Alternatively, a blanket could be configured as an endless belt and rotated as the member 12 is in FIG. 1 and FIG. 2 for formation of an aqueous image. Other variations of these structures can be configured for this purpose. As used in this document, the term "intermediate imaging surface" includes these various configurations.

In some printing operations, a single ink image can cover the entire surface 14 of the blanket 21 (single pitch) or a plurality of ink images can be deposited on the blanket 21 (multi-pitch). In a multi-pitch printing architecture, the surface of the image receiving member can be partitioned into multiple segments, each segment including a full page image in a document zone (i.e., a single pitch) and inter-document zones that separate multiple pitches formed on the blanket 21. For example, a two pitch image receiving member includes two document zones that are separated by two inter-document zones around the circumference of the blanket 21. Likewise, for example, a four pitch image receiving member includes four document zones, each corresponding to an ink image formed on a single media sheet, during a pass or revolution of the blanket 21.

Once an image or images have been formed on the blanket and coating under control of the controller 80, the illustrated inkjet printer 10 operates components within the printer to perform a process for transferring and fixing the image or images from the blanket surface 14 to media. In the printer 10, the controller 80 operates actuators to drive one or more of the rollers 64 in the media transport system 50 to move the media sheet 49 in the process direction P to a position adjacent the transfix roller 19 and then through the transfix nip 18 between the transfix roller 19 and the blanket 21. The transfix roller 19 applies pressure against the back side of the recording media 49 in order to press the front side of the recording media 49 against the blanket 21 and the image receiving member 12. Although the transfix roller 19 can also be heated, in the exemplary embodiment of FIG. 1, the transfix roller 19 is unheated. Instead, the pre-heater assembly 52 for the media sheet 49 is provided in the media path leading to the nip. The pre-conditioner assembly 52 conditions the media sheet 49 to a predetermined temperature that aids in the transferring of the image to the media, thus simplifying the design of the transfix roller. The pressure produced by the transfix roller 19 on the back side of the heated media sheet 49 facilitates the transfixing (transfer and fusing) of the image from the image receiving member 12 onto the media sheet 49.

The rotation or rolling of both the intermediate rotating member 12 and the transfix roller 19 not only transfixes the images onto the media sheet 49, but also assists in transporting the media sheet 49 through the nip. The intermediate rotating member 12 continues to rotate to continue the transfix process for the images previously applied to the coating and blanket 21.

In the embodiment shown in FIG. 2, like components are identified with like reference numbers used in the description of the printer in FIG. 1. One difference between the printers of FIG. 1 and FIG. 2 is the type of media used. In the embodiment of FIG. 2, a media web W is unwound from a roll of media 204 as needed and a variety of motors, not shown, rotate one or more rollers 208 to propel the media web W through the nip 18 so the media web W can be wound onto a roller 212 for removal from the printer. One configuration of the printer 200 winds the printed media onto a roller for removal from the system by rewind unit 214. Alternatively, the media can be directed to other processing stations that perform tasks such as cutting, binding, collating, and/or stapling the media or the like. One other difference between the printers 10 and 200 is the nip 18. In the printer 200, the transfer roller continually remains pressed against the blanket 21 as the media web W is continuously present in the nip. In the printer 10, the transfer roller is configured for selective movement towards and away from the blanket 21 to enable selective formation of the nip 18. Nip 18 is formed in this embodiment in synchronization with the arrival of media at the nip to receive an ink image and is separated from the blanket to remove the nip as the trailing edge of the media leaves the nip.

As noted above, an aqueous printer having the structure shown in FIG. 1 or FIG. 2 can have one optical sensor 94A, 94B, 94C, or 94D, or any combination or permutation of image sensors at these positions about the rotating member 12. The advantage of having multiple image sensors is that any subsystem affecting the print cycle can be monitored without having to disable the ability to print continuously. When a subsystem that needs to be monitored is not immediately followed by an optical sensor, then the subsystems that lie between that subsystem and the next available optical sensor must be disengaged. An operation must occur with respect to a portion of the intermediate imaging surface followed by continued rotation of the intermediate imaging surface so that portion reaches the optical sensor, which is operated to generate image data of the surface that can be analyzed to evaluate the operation. The intermediate imaging surface then continues to rotate until the portion of the surface that was imaged reaches the next operational station position so an operation can be performed. The surface is rotated until that portion on which the operation occurred reaches the optical sensor for imaging so the next operation performed on the surface can be evaluated. This requirement disables the ability to print for at least one rotation of the drum any time a subsystem needs to be monitored. For example, in a printer embodiment having a single optical sensor and the need to monitor the surface applicator 120, the intermediate imaging surface continues rotation following surface treatment of a portion of the surface by the surface energy applicator 120 without operating the printheads 34A to 34D to eject ink or activating the heater 130 so the treated portion of the imaging surface can be imaged by optical sensor 94C, when optical sensor 94C is the only optical sensor in the printer. This example can be extended to complete a multi-pass print cycle that enables printer embodiments with only one optical sensor or less than all of the optical sensors 94A, 94B, 94C, and 94D to generate image data of the intermediate imaging surface and scrutinize the performance of various components in the printer.

In printers that have all of the optical sensors 94A, 94B, 94C, and 94D, image data of the imaging surface can be generated after each of the operations of surface treatment and printing with applicator 120 and printheads 34A-34D, drying the ink image with heater 130, transferring the image at nip 18, and cleaning the surface with SMU 92. If evaluation of the surface treatment needs to be tested independently of printing, then another optical sensor could be installed between the applicator 120 and the printhead 34D, although the characteristics on the imaging surface provide good insight into the effectiveness of the surface treatment. Additionally, optical sensor 94E is provided if the quality of the ink image on media is to be tested.

In solid ink printing, one optical sensor positioned after a print zone is effective for evaluating operation of the printer because the ink "freezes" and remains relatively stationary on the imaging surface after the ejected ink lands on the surface. Aqueous ink is more mobile on the imaging surface until an adequate amount of water and/or solvent has been removed. Additionally, the printing of aqueous ink drops that are offset from one another by small distances, such as one-half of the distance between inkjet nozzles, can be susceptible to problems, such as bleeding into one another. The bleeding of ink drops leads to perceptible defects in the images on the media. In solid ink printing, most of the image defects arise from printhead issues, such as printhead alignment, missing inkjets, printhead intensities, and the like. Consequently, an optical sensor positioned almost anywhere following the print zone generates image data that can be analyzed to detect these issues. In aqueous printers, image defects arising from aqueous ink characteristics can be caused by the components treating the imaging surface, the environment in the print zone between the printheads and the imaging surface, the dryer effectiveness, and the transfer efficiencies. Thus, the imaging surface in aqueous inkjet printers needs to be imaged with and without ink and at different positions during a single print cycle to evaluate the myriad subsystems that affect image quality in the printer.

To address these issues affecting image quality in aqueous printers, the printer of FIG. 1 and FIG. 2 include multiple optical sensors to generate image data of the blanket 21 at different positions in a single print cycle or operate a single optical sensor one or multiple times for a single print cycle that is performed in one or multiple revolutions of the blanket. Such operation of the optical sensor(s) enables multiple components at different positions in the print cycle to be tested and adjusted to address image quality issues. Additionally, the light source in the optical sensors can be oriented with reference to the blanket surface to detect specular reflection or diffuse reflection. Also, the color of the light in one or more sensors can be adjusted to enhance the visibility of specific inks or blankets, and multiple color light sources associated with one or more sensors can be sequentially used to enhance detection of the various ink colors such as complementary colors.

Five basic functions of a print cycle are controlled and monitored by the controller analyzing image data from the optical sensors 94A to 94D in FIG. 1 and FIG. 2. The five functions are 1) printhead performance, alignment, and timing; 2) ink drop coalescence, ink drop spread, and inter-color bleed; 3) coherence of film for image transfer; 4) image surface cleanliness; and 5) transfer nip effectiveness. A sixth function, overall print quality, can be analyzed with reference to image data generated by optical sensor 94E, which images the ink on the media after the print is finalized.

Printhead alignment includes detection of individual printhead roll and alignment between multiple printheads with reference to one another in the cross-process direction. Printhead timing refers to the delivery of the firing signals to the printheads so that each printhead and/or each inkjet in each printhead fires at the correct time in the process direction with respect to the other printheads or inkjets. The intensity of the color of the ink ejected by a printhead or even by inkjets within a printhead can vary. Consequently, the color intensity of printheads and/or inkjets within a printhead is monitored and, if the variation exceeds a threshold, adjustments made to the image data used to generate the firing signals or the firing signals delivered to a printhead can be adjusted with a trimming adjustment. Printhead performance includes detecting and compensating for weak and missing inkjets.

As previously noted, aqueous ink remains mobile for a relatively long period after ejection. The time period between a first aqueous ink drop arriving at an imaging surface and a second aqueous ink drop arriving at an imaging surface varies with respect to the coalescence issue being evaluated. For ink drops ejected by the same inkjet, the time scale is on the order of 10 μ seconds. For ink drops ejected from neighboring jets, the time scale is closer to 100 μ seconds. For ink drops ejected by a printhead ejecting ink for one color compared to ink drops ejected by a printhead ejecting ink of another color, the time scale is more on the order of 1-10 m seconds when each color of ink is ejected from a different printhead. Moreover, when a print cycle is performed over multiple revolutions of the imaging surface, the time scale for transfixing ink drops ejected by printheads ejecting different colors can be on the order of a second. This time scale is important because the first ink has at least that amount of time to dry before the subsequent ink drops land.

A number of control parameters can be adjusted to reduce coalescence of ink drops. As used in this document, "coalescence" refers to an ink drop merging with an adjacent ink drop. Primary controls for coalescence on an imaging surface include regulation of temperatures in the print zone and drying zone. Temperature control for ink drop coalescence has to be balanced with the competing concern that high temperatures in the print zone may cause ink to dry in the inkjet nozzles or evaporated water to condense on printhead faces. Thus, the temperature in the print zone is controlled to begin ink drying, but most of the water/solvent evaporation is done in the drying zone.

Figure 3A:
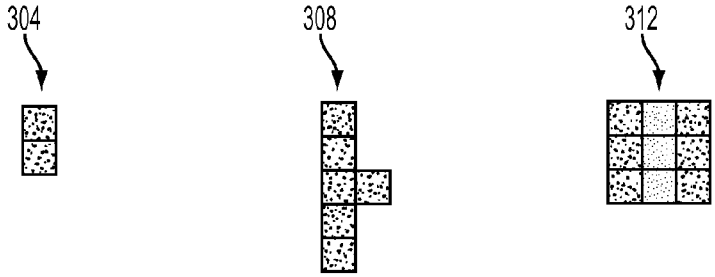
FIG. 3A depicts digital images that are sensitive to ink drop coalescence for a single inkjet, neighboring inkjets, and inkjets from printheads ejecting different colors of ink, respectively.

To evaluate coalescence on the imaging surface, test patterns can be printed onto the imaging surface and then imaged by an optical sensor. The image data can be analyzed to identify the extent that ink drops merge with one another. A few examples of target patterns that could be printed to aid in measuring coalescence during the various time scales noted above are shown in FIG. 3A. Pattern 304 is formed by ink drops from a single inkjet. Pattern 308 is formed by ink drops from neighboring inkjets in a printhead, and pattern 312 is formed by ink drops of different colors ejected by at least two different printheads. The patterns 316, 320, and 324 shown in FIG. 3B depict the image data obtained from the printed test patterns 304, 308, and 312, respectively, when coalescence between ink drops is well controlled and the patterns 328, 332, and 336 shown in FIG. 3C illustrate the image data obtained from the printed test patterns 304, 308, and 312, respectively, when coalescence between ink drops is not well controlled.

In some embodiments, the optical sensors 94A to 94D have a resolution on the order of the features of drop coalescence that are being measured. Regulation of drop coalescence to the degree required for high image quality, however, necessitates ink drop boundary control to a precision higher than the resolution of such sensors. This precision can be accomplished by making repeat measurements for both the same nozzles and simultaneous measurements for different nozzles across the printhead.

Figure 3B:
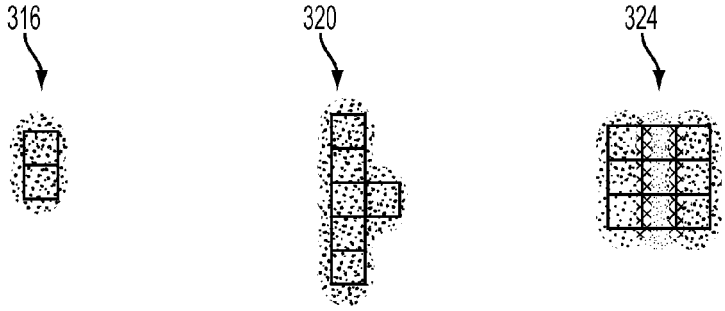
FIG. 3B depicts the ink coverage on the media from the printed test patterns of FIG. 3A, respectively, when coalescence of the ink drops is well controlled.
Figure 3C:
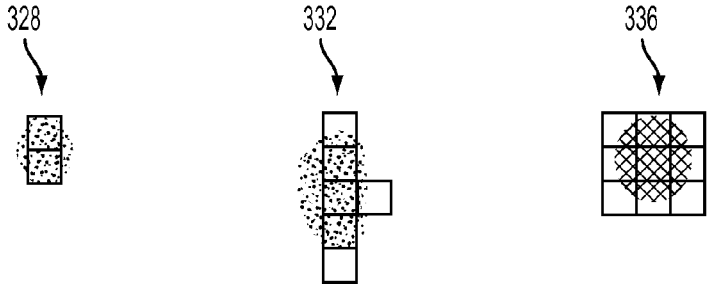
FIG. 3C depicts the ink coverage on the media from the printed test patterns of FIG. 3A, respectively, when coalescence of the ink drops is not well controlled.
Figure 4B:
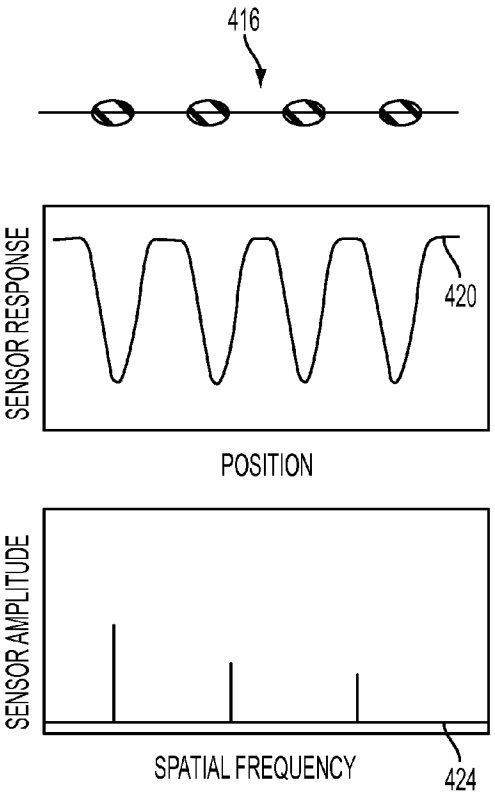
FIG. 4B depicts a profile through the image data for a test pattern in which the ink drops coalesce more than the ink drops in FIG. 4A and the Fourier transform of the profile.
Figure 4A:
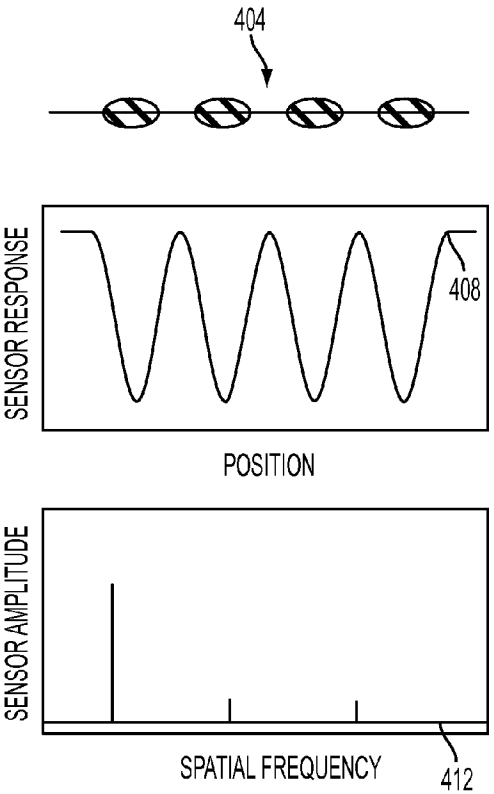
FIG. 4A depicts a profile through the image data for a test pattern in which the ink drops do not coalesce and the Fourier transform of that profile.

For example, as observed when FIG. 3C is compared to FIG. 3B, the length of a two pixel process direction line is longer when the drop coalescence is controlled than when it is not controlled. For a single drop, this length is not only difficult to measure with high precision, but the degree of coalescence may vary between any two particular drops. To avoid the imprecision arising from this variance and resolution, a repeating pattern of two pixel drops is printed in the process direction. For drops that do not coalesce, the profile through the ink drops is different than the profile through the ink drops that do coalesce. A noise free metric of this difference in structure can be determined with the ratio of the fundamental frequency to the second harmonic in a Fourier transform of the profile. In FIG. 4A, a process direction profile 404 is shown for the controlled coalescence ink drop pattern 408 along with the Fourier transform 412 for the profile; while FIG. 4B shows a process direction profile 416 for a less controlled coalescence ink drop pattern 420 along with the Fourier transform 424 for the profile. Depending on the type of coalescence being measured (FIG. 3A), variations in the dash length, dash spacing, and structure of the dash can be chosen to highlight the difference between the appearance of the dash with and without drop on drop coalescence.

Similar strategies can be chosen for neighboring jet coalescence as well. If neighboring drops coalesce, in the same way as illustrated above, a test pattern can be designed that is sensitive to this coalescence. For example, the two drop pattern 308 in FIG. 3A could be rotated 90 degrees so the drops are coming from neighboring jets and the same sort of analysis as described for the two drop process direction pattern could be performed. Alternatively, a test pattern similar to the test pattern 312 in FIG. 3A can be used and process direction profiles used to analyze the coalescence. If the drops do not coalesce, then the pixel in the image data from an optical sensor that corresponds to the long left nozzle sequence responds with a high amplitude signal and the pixel in the image data from the optical sensor that corresponds to the right single drop responds with a low amplitude signal. If the right drop coalesces into the other drops then no response is obtained from the pixel in the image data from the optical sensor that corresponds to the right single drop. Other variations of the test pattern can be devised to be sensitive to the particular ways in which the ink drops coalesce.

For inter-color bleed, a repeating pattern of either lines or a grid at a spatial frequency on the order of the bleed between the two colors can be printed. The pattern is imaged by an optical sensor using an illumination color that gives a higher reflectance for one color and a lower reflectance for the other color. If the two colors do not bleed into each other, the repeating pattern is resolved, but if the two colors bleed into each other the amplitude of the repeating pattern is significantly reduced.

In response to the parameters of ink coalescence, ink drop spread, and inter-color bleed exceeding a predetermined threshold, a controller can adjust components to address the detected issues. For example, ink drop coalescence can be affected by the surface energy applicator and/or any coatings being applied to the blanket surface. Consequently, the controller can change the thickness of the coating or adjust the level of the electrical power applied to the surface energy applicator or operate an actuator to change the distance between the surface energy applicator and the blanket surface.

To perform the third function and control film coherence, the image is first adequately dried and then brought to a temperature appropriate to form a cohesive film as it is transferred to the media. Binding the colorant particles of the dried ink under heat is similar to the fusing of toner particles in a xerography machine. If the film is heated too aggressively prior to transfer, a possibility arises that the film could stick to the blanket. If the film is not heated enough prior to transfer, a possibility arises that the liquid in the ink will be absorbed along with the colorant into the media. This absorption results in degradation in image quality. Adequate latitude in these processes is essential to enabling successful transfer of isolated drops as well as secondary, tertiary, and other heavy ink colors. To achieve this latitude, the dried state and the film/molten state of the ink on the blanket can be effectively monitored optically. The geometry of the film changes as a function of the amount of liquid in the film. One way to detect the geometry is to monitor variations in the specular reflection from the ink surface, which is referred to as "image gloss." After the ink image is dried on the blanket, ink gloss is typically significantly lower than that of the wet film. Depending upon the constituents in the ink, ink gloss goes through another significant change, either higher or lower, when ink reaches a temperature that is high enough to cause the ink to become a film or begin flowing.

One way of imaging the blanket surface to evaluate film coherence during transfer is to disengage the cleaner and monitor ink residue on the blanket with the optical sensor 94A. If the temperature or pressure of the transfix roller is not optimal the mass of the residual ink on the blanket exceeds a predetermined threshold. If non-uniformities in the drying temperature exist, the density of the residual ink on the blanket can vary over the drum surface. Image data of the paper generated with the optical sensor 94E can also be used to assess transfer efficiency. In this evaluation scheme, the transfer of a target pattern onto media can be imaged. The blanket is then rotated another revolution without further printing or processing and a second transfer to new media is performed. The image data of the second media print is analyzed for ink residue.

If the ink film is not adequately dry, the ink image may not have adequate structural coherence to transfer as a whole to the media. This phenomenon is called film split. Something analogous occurs with solid ink when the temperature of the intermediate imaging member is too high and the wax in the ink becomes too fluid. To solve film split in aqueous ink printing, more drying would be necessary, an approach that is nonsensical in solid ink printing because a dryer is not used in solid ink printers to prepare the ink image for transfer. This additional drying is most likely used to avoid film split in images having heavy coverage areas. Inadequate film coherence can also occur in response to excessive heating of isolated dots or lines. Such heating causes the lower masses of the isolated dots or lines to reach a high enough temperature to begin bonding to the blanket and prohibit release from the substrate.

In response to the parameters of film coherence exceeding a predetermined threshold, a controller can adjust dryer components to address the detected issues. For example, film coherence can be affected by the convective heater and/or the infrared heater. Consequently, the controller can change the level of the electrical power applied to either heater or change the speed of any fan used to circulate air about the blanket surface.

To perform the fourth function of evaluating blanket cleanliness, the image data of the blanket surface is generated shortly after the surface exits the cleaner. Ink residue left on the blanket can occur from the mechanisms discussed previously with regard to film coherence and/or ink residue can come from inter-document zone targets, such as the test patterns printed in these zones for the detection of inoperative inkjets. In either case, surface cleaning is important to ensure adequate image quality for subsequent prints in addition to preventing degradation of the blanket surface. To diagnose a cleaning failure, the blanket surface is imaged twice. Once with the cleaner disengaged to image the amount of ink that is to be removed and the second time after the cleaner engaged the surface to remove the ink. To increase the measurement sensitivity, a repeating target is printed. Even if the mass of the residual ink is quite low and difficult to measure, a signal at the repeat period, which is proportional to the residual ink mass, could be detected.

In response to the parameters of surface cleanliness, such as residual ink measurements, exceeding a predetermined threshold, a controller can adjust components to address the detected issues. For example, surface cleanliness can be affected by the pressure applied by a contact cleaning roller or by the amount of cleaning solution being applied to the blanket surface. Consequently, the controller can change the amount of the cleaning solution or operate an actuator to change the pressure applied to the blanket surface by the cleaner.

The fifth function of measuring image quality on the media is determined with reference to image data generated by the optical sensor 94E. These image data are used to measure the post transfer and release image-measurable aspects of the final print. Alteration of the media by the transfer roller in the transfer nip 18 can be identified from analysis of these image data. For example, temperature and/or pressure stresses that adversely impact the media or the ink can be detected in the image data. Also, non-uniformity in the application of the pressure or in the media material can be detected as well as artifacts that appear in the media as a result of ineffective releasing or stripping of the media from the blanket. Media dependent dimensional instabilities, such as media shrinkage or stretching, caused by the conditions in the nip can be identified from the image data generated by optical sensor 94E. A controller can adjust the pressure and/or temperature in the nip 18 in response to these media instabilities exceeding a predetermined threshold to maximize print quality.

Figure 5:
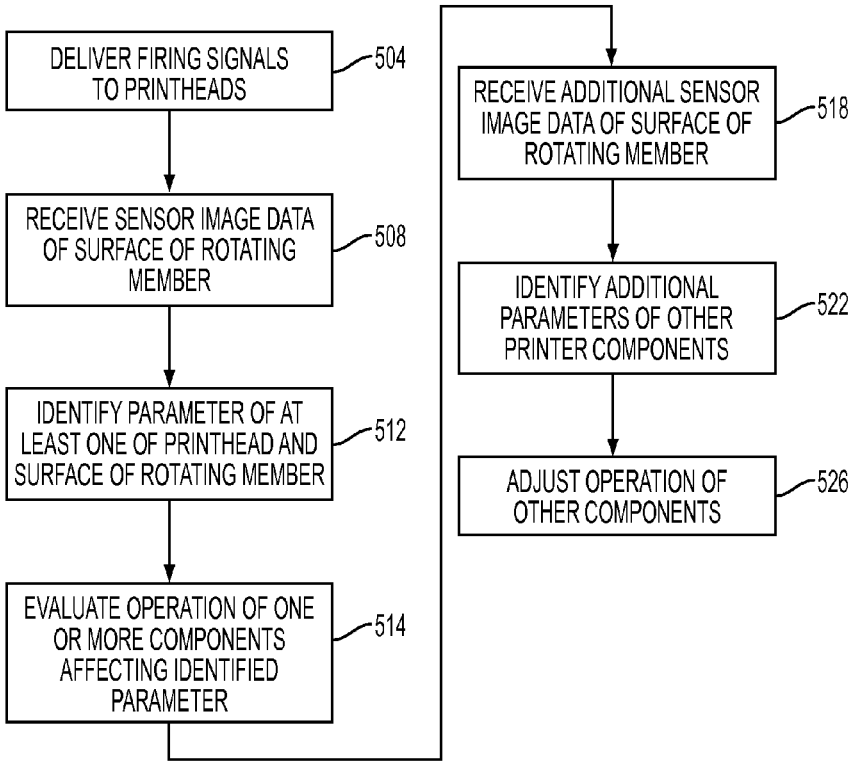
FIG. 5 is a flow diagram of a process for operating an aqueous inkjet printer to control the components of the printer with reference to optical sensor image data.

A method for operating an aqueous inkjet printer is shown in FIG. 5. In the description of the method, a statement that the process is performing some function refers to a processor or controller executing programmed instructions stored in a memory operatively connected to the processor or controller to operate one or more printer components to perform the function. In the process, firing signals are delivered to the printheads to eject aqueous ink onto a surface of a rotating member positioned to rotate in front of the printheads to form an aqueous ink image on the surface of the rotating member (block 504).

A controller receives from at least one optical sensor image data of the surface of the rotating member (block 508) and identifies a parameter of at least one of the at least one printhead and the surface of the rotating member (block 512). "Parameter" as used in this document refers to a physical characteristic of ink on the intermediate imaging surface, coating on the intermediate imaging surface, and/or the surface itself that can be measured. For example, the position of ink drops, the spread of ink drops, color of ink drops, thicknesses of coatings, and features in the surface of the intermediate imaging surface can be measured. "Identify" as used in this document refers to any calculation, arithmetic or logical operation, which is used to measure or quantify in some manner a parameter. Examples of parameters include detecting inoperative inkjets, printhead misalignment, intensity differences, and process direction ink drop placement error with reference to the image data of the surface of the rotating member received from one of the optical sensors or from a single sensor that generates data at different times during a single multi-revolution cycle. Other parameters include ink drop bleeding, ink drop coalescence, ink drop spread, film coherence, and residual ink. As noted above, some of these parameters can be analyzed with reference to a single inkjet, at least two neighboring inkjets, and inkjets in different printheads.

After a parameter is identified, the controller evaluates the operation of one or more components affecting the identified parameter (block 514) by, for example, comparing the identified parameter to a predetermined threshold. In response to an identified parameter exceeding a threshold, the controller can adjust one or more of the components affecting the identified parameter. For example, electrical power supplied to a dryer to dry the aqueous ink image formed on the surface of the rotating member can be regulated. Other adjustments include changes to firing signals, pressure applied by the transfer roller, the temperature of the transfer roller, an angle of a cleaner wiper, a pressure of the wiper against the surface of the rotating member, an amount of cleaning solution applied to the surface of the rotating member, a voltage supplied to the surface energy applicator, and a distance between the surface energy applicator and the low energy layer. These adjustments can be performed independently of one another or one or more of the adjustments can be applied substantially simultaneously.

The controller can identify parameters and adjust one or more printer components with reference to image data from a single image generated by a single optical sensor. The controller can also identify parameters and make adjustments with reference to image data from multiple images received from multiple optical sensors during a single print cycle or over two or more print cycles. The generation of optical sensor image data at different times during a single print cycle enables the controller to identify parameters and adjust different components of the printer that affect the print cycle.

Within the print cycle, additional image data of the imaging surface can be obtained (block 518). These additional image data can be obtained from another optical sensor or by rotating the rotating member for additional passes and generating the image data with the same optical sensor that generated the first image during the print cycle. The additional image(s) are processed to identify parameters for other components in the printer (block 522) and these components can be adjusted (block 526). These other components include the surface energy applicator, the cleaner, the dryer, and the transfer roller.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A printer comprising:

at least one printhead configured to eject aqueous ink;

a rotating member being positioned to rotate in front of the at least one printhead to enable the at least one printhead to eject aqueous ink onto the surface of the rotating member and form an aqueous ink image on the surface of the rotating member;

a first optical sensor and a second optical sensor, the first optical sensor being configured to generate image data of the surface of the rotating member at a first time, and the second optical sensor being configured to generate image data of the surface of the rotating member at a second time, one of the first time and the second time occurring later than the other of the first time and the second time, and both the first time and the second time occurring during a single print cycle; and a controller operatively connected to the first optical sensor and the second optical sensor, the controller being configured to receive from the first optical sensor and the second optical sensor image data of the surface of the rotating member at the first time and the second time, respectively, identify a parameter of at least one of the at least one printhead and the surface of the rotating member with reference to the image data received at the first time, and identify a parameter of the other of the at least one printhead and the surface of the rotating member with reference to the image data received at the second time.

2. The printer of claim 1, the surface of the rotating member further comprising:

a low surface energy layer.

3. The printer of claim 1, the controller further configured to:

detect at least one of ink drop bleeding, ink drop coalescence, and inadequate ink drop spread with reference to the image data of the surface of the rotating member generated by the first optical sensor and the second optical sensor.

4. The printer of claim 1, the controller being further configured to:

detect at least one of ink drop bleeding, ink drop coalescence, and inadequate ink drop spread with reference to the image data of the surface of the rotating member received at the first time or the second time.

5. The printer of claim 4, the controller being configured to:

detect the ink drop bleeding, the ink drop coalescence, and the inadequate ink drop spread with reference to a single inkjet, at least two neighboring inkjets, and inkjets in different printheads.

6. The printer of claim 1, the controller being further configured to:

detect at least one of inoperative inkjets, printhead alignment, intensity differences, and process direction ink drop placement error with reference to the image data of the surface of the rotating member received at the first time or the second time.

7. The printer of claim 1 further comprising:

a dryer positioned with reference to the rotating member to dry the aqueous ink image formed on the surface of the rotating member by the at least one printhead; and the controller being further configured to identify a parameter of the dryer with reference to the image data of the surface of the rotating member generated by the first optical sensor and the second optical sensor.

8. The printer of claim 7, the controller being further configured to identify the parameter of the dryer by detecting image film coherence on the surface of the rotating member.

9. The printer of claim 1 further comprising:

a dryer positioned with reference to the rotating member to dry the aqueous ink image formed on the surface of the rotating member by the at least one printhead; and the controller being further configured to identify a parameter of the dryer with reference to image data of the rotating surface received from a third optical sensor at a third time, the third time occurring during the single print cycle at a time that is different than the first time and the second time.

10. The printer of claim 9, the controller being further configured to adjust operation of the dryer in response to the identified parameter being greater than a predetermined threshold.

11. The printer of claim 1 further comprising:

a transfer roller configured to form a nip with the surface of the rotating member to enable the aqueous ink image to transfer to media as media passes through the nip; and the controller being further configured to identify a parameter of the transfer roller with reference to the image data of the rotating surface generated by the first optical sensor and the second optical sensor.

12. The printer of claim 11, the controller being further configured to:

adjust at least one of a pressure applied by the transfer roller in the nip and a temperature of the transfer roller in response to a measured amount of ink on the surface of the rotating member being greater than a predetermined threshold.

13. The printer of claim 11 further comprising:

a cleaner configured to remove ink from the surface of the transfer roller after the aqueous ink image has transferred to the media; and the controller being further configured to identify a parameter of the cleaner with reference to the image data of the rotating surface generated by the first optical sensor and the second optical sensor.

14. The printer of claim 1 further comprising:

a transfer roller configured to form a nip with the surface of the rotating member to enable the aqueous ink image to transfer to media as media passes through the nip; and the controller being further configured to identify a parameter of the transfer roller with reference to image data of the rotating surface received from a third optical sensor at a third time, the third time occurring during the single print cycle at a time that is different than the first time and the second time.

15. The printer of claim 14 further comprising:

a cleaner configured to remove ink from the surface of the transfer roller after the aqueous ink image has transferred to the media; and the controller being further configured to identify a parameter of the cleaner with reference to image data received from a fourth optical sensor at a fourth time, the fourth time occurring during the single print cycle at a time that is different than the first time, the second time, and the third time.

16. The printer of claim 15, the controller being further configured to:

adjust at least one of an angle of a wiper, a pressure of the wiper against the surface of the rotating member, and an amount of cleaning solution applied to the surface of the rotating member in response to a measured amount of ink on the surface of the rotating member being greater than a predetermined threshold.

17. The printer of claim 1 further comprising:

a surface energy applicator configured to generate an electric field to produce and direct energized particles towards the surface of the rotating member, the surface energy applicator being positioned to direct the energized particles towards the surface of the rotating member before the at least one printhead ejects aqueous ink onto the surface of the rotating member treated with the energized particles; and the controller being further configured to identify a parameter of the surface energy applicator with reference to image data received from a third optical sensor at a third time, the third time occurring during the single print cycle at a time that is different than the first time and the second time.

18. A printer comprising:

at least one printhead configured to eject aqueous ink;

a rotating member being positioned to rotate in front of the at least one printhead to enable the at least one printhead to eject aqueous ink onto the surface of the rotating member and form an aqueous ink image on the surface of the rotating member;

at least one optical sensor configured to generate image data of the surface of the rotating member;

a surface energy applicator configured to generate an electric field to produce and direct energized particles towards the surface of the rotating member, the surface energy applicator being positioned to direct the energized particles towards the surface of the rotating member before the at least one printhead ejects aqueous ink onto the surface of the rotating member treated with the energized particles; and a controller operatively connected to the at least one optical sensor and the surface energy applicator, the controller being configured to receive from the at least one optical sensor image data of the surface of the rotating member and identify a parameter of the surface energy applicator with reference to image data received from the at least one optical sensor.

19. The printer of claim 18, the controller being further configured to:

adjust at least one of a voltage supplied to the surface energy applicator and a distance between the surface energy applicator and the surface of the rotating member in response to at least one of ink drop bleeding, ink drop coalescence, and ink drop spread being greater than a predetermined threshold.

* * * * *